United States Patent [19]

Haruki

[11] Patent Number: 4,967,194

[45] Date of Patent: Oct. 30, 1990

[54] RADIO MESSAGE DISPLAY SYSTEM

[75] Inventor: Toshihiro Haruki, Tokyo, Japan

[73] Assignee: NEC Corporation, Japan

[21] Appl. No.: 10,404

[22] Filed: Feb. 3, 1987

[30] Foreign Application Priority Data

Feb. 5, 1986 [JP] Japan ..... 61-24418

[51] Int. Cl.[5] ..... G08B 5/22

[52] U.S. Cl. ..... 340/825.440; 340/825.48; 340/311.1

[58] Field of Search ..... 340/825.44–825.48, 340/825.69, 825.72, 311.1, 717, 792, 323 R; 455/31, 38, 158, 228, 349, 351, 346–348; 379/56, 57, 96, 354; 358/194.1, 254

[56] References Cited

U.S. PATENT DOCUMENTS

| | | | |
|---|---|---|---|
| 3,976,995 | 8/1976 | Sebestyen | 340/825.44 |
| 3,981,002 | 9/1976 | Gardner | 340/323 R |
| 4,208,630 | 6/1980 | Martinez | 340/825.44 |
| 4,264,979 | 4/1981 | Gutowsky | 455/158 |
| 4,336,524 | 6/1982 | Levine | 455/31 |
| 4,369,443 | 1/1983 | Giallanza et al. | 340/825.44 |
| 4,422,071 | 12/1983 | de Graff | 340/825.44 |
| 4,473,824 | 9/1984 | Claytor | 340/792 |
| 4,578,739 | 3/1986 | McKee et al. | 455/349 |
| 4,661,972 | 4/1987 | Kai | 379/56 |
| 4,680,785 | 7/1987 | Akiyama et al. | 379/57 |
| 4,686,528 | 8/1987 | Ferrer et al. | 340/825.44 |
| 4,804,955 | 2/1989 | Yoshizawa | 340/825.44 |

FOREIGN PATENT DOCUMENTS

| | | | |
|---|---|---|---|
| 0193527 | 8/1986 | Japan | 340/825.44 |

*Primary Examiner*—Donald J. Yusko
*Assistant Examiner*—Edwin C. Holloway, III
*Attorney, Agent, or Firm*—Ostrolenk, Faber, Gerb & Soffen

[57] ABSTRACT

A radio message display system for transmitting a message entered on an input device over a radio link which is set up by a paging transmitter and a paging receiver, the message being displayed on a display panel. A transmit side is provided with an encoder for coding the message entered on the input device, and the paging transmitter adapted to modulate a carrier by the coded message and transmitting the modulated carrier. A receive side, on the other hand, is provided with the display panel in which the paging receiver is accommodated for receiving and demodulating the carrier. The receiver may display the message on a display section thereof or deliver it to an external output terminal thereof. The display panel supplied with the message via the output terminal of the receiver displays it on another display section.

12 Claims, 4 Drawing Sheets

| BIT SYNC | FRAME SYNC | ADDRESS | COMMAND | DATA | ERROR-CORRECTION CODE |
|---|---|---|---|---|---|

RADIO MESSAGE DISPLAY SYSTEM

BACKGROUND OF THE INVENTION

The present invention relates to a message display system for displaying on a display panel an entered message and, more particularly, to a radio message display system for displaying a message on a display panel by transmitting it over a radio link which is established by a paging transmitter and a paging receiver.

Two different systems have heretofore been available to display messages in alphanumeric and other characters and graphics, i.e., a system in which a message entered on an input device is transmitted by wire to a display panel, and a system in which messages are stored in an exclusive data storage built in a display panel and selectively read therefrom. Both of the wired connection type scheme and the built-in storage type scheme, have drawbacks in that the installation, layout modification and other tasks require troublesome work, and that the contents to be displayed cannot be changed.

SUMMARY OF THE INVENTION

It is therefore an object of the present invention to provide a radio message display system in which a display panel for displaying messages can be installed and modified in layout with ease.

It is another object of the present invention to provide a radio message display system in which messages to be displayed on a display panel can be changed easily.

It is another object of the present invention to provide a generally improved radio message display system.

A radio message display system for displaying a message entered by transmitting the message over a radio link of the present invention comprises an input device for entering a message, an encoder for coding an output of the input device, a paging transmitter for modulating a carrier by an output of the encoder and transmitting the carrier modulated as a radio carrier, a paging receiver for receiving and demodulating the radio carrier to produce the message, the message being displayed on a display of the receiver or delivered to an external output terminal of the receiver, and a display panel having a display section for displaying the message which is outputted via the external output terminal of the receiver, the receiver being accommodated in the display panel.

The above and other objects, features and advantages of the present invention will become more apparent from the following detailed description taken with the accompanying drawings.

DESCRIPTION OF THE PREFERRED EMBODIMENT

Figure 1:
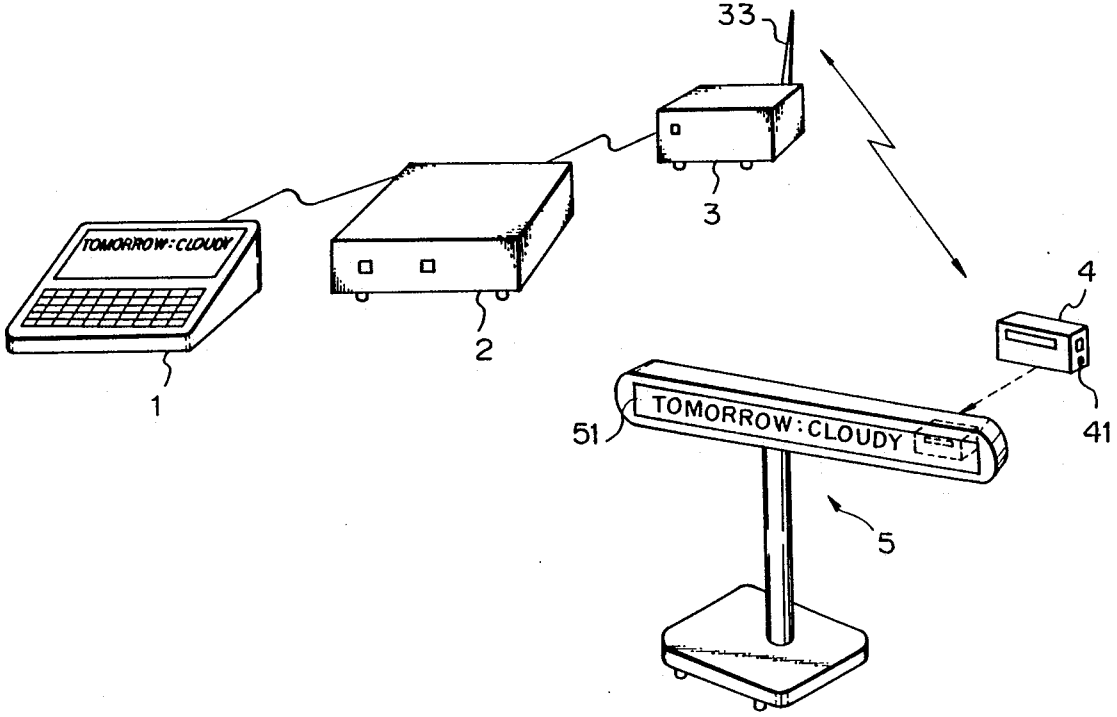
FIG. 1 is a view showing a radio message display system in accordance with the present invention.

Referring to FIG. 1 of the drawings, a radio message display system embodying the present invention is shown. In this particular embodiment, a message inputted on an input device 1 is coded by an encoder 2 and then fed to a paging transmitter 3. The transmitter 3 modulates a carrier by the coded information and transmits the modulated carrier as an electromagnetic wave. On the other hand, a paging receiver 4 which is installed in a a generally T-shaped display panel 5 receives and demodulates the radio carrier transmitted and delivers it to the display panel 5 via an external output terminal 41 thereof. As a result, the message entered on the input device 1 is displayed on a display 51 of the display panel 5.

Figure 2:
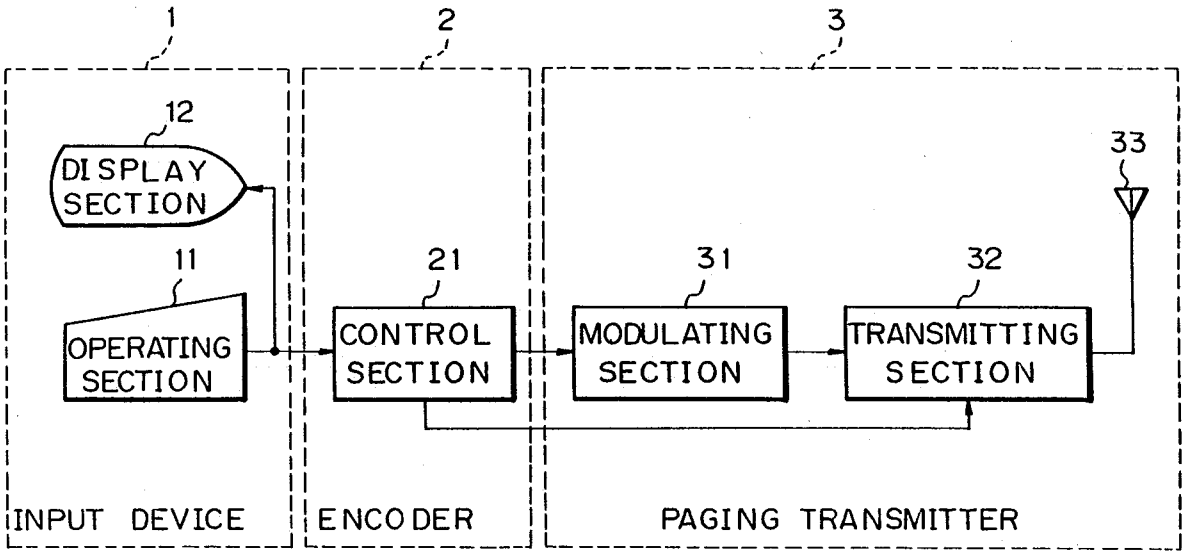
FIG. 2 is a block diagram showing an input device, an encoder and a paging transmitter which are included in the system of FIG. 1.

FIG. 2 shows the input device 1, encoder 2 and transmitter 3 in a system block diagram. As a person manipulates an operating section 11 of the input device 1 to enter a desired message, the message is displayed on a display section 12 of the device 1 and, at the same time, applied to a control section 21 of the encoder 2. In response, the encoder 2 converts the message into a message signal having a particular signal format which will be described. The message signal is fed to a modulating section 31 of the transmitter 3 so as to modulate a subcarrier. The subcarrier modulated is applied to a transmitting section 32 of the transmitter 3 to modulate a carrier. The output of the section 32 is transmitted as an electromagnetic wave via an antenna 33.

Figure 3:
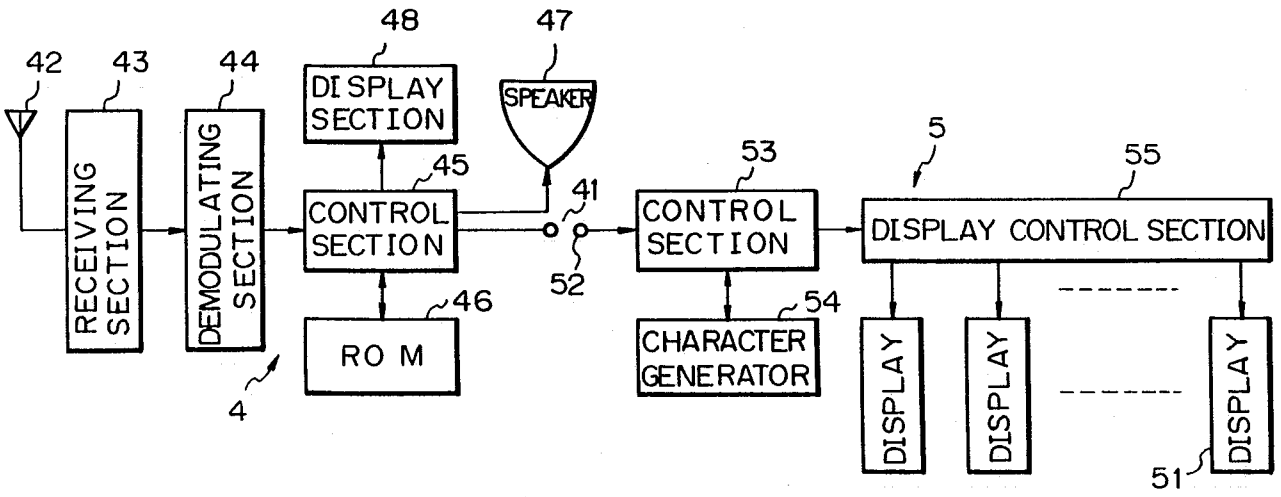
FIG. 3 is a block diagram showing a paging receiver and a display panel also included in the system of FIG. 1.

Referring to FIG. 3, the display panel 5 and the paging receiver 4 which is accommodated in the display panel 5 are shown in a block diagram. An antenna 42 is installed in the receiver 4 to receive the electromagnetic wave which is sent from the transmitter 3. The electromagnetic wave received is fed as a carrier to a receiving section 43 of the receiver 4. The receiving section 43 demodulates the input carrier to produce a subcarrier which is then applied to a demodulating section 44. This section 44 further demodulates the subcarrier to convert it into logical data the format of which is described below (see FIG. 4), the logical data being routed to a control section 45. In response, the control section 45 determines whether the data matches with a particular address number which is stored in a read only memory (ROM) 46 and, if matched, produces an alert tone through a speaker 47 while displaying the content of the message on a displaying section 48.

Where the receiver 4 is mounted in the display panel 5, the signal from the control section 45 of the receiver 4 is applied to a storage control section 53 of the display panel 5 via the external output terminal 41 of the receiver 4 and an input terminal 52 of the display panel 5. The storage control section 53 transforms the logical data into dot data by means of a character generator 54 and supplies a display control section 55 with the dot data to be displayed, whereby the message is displayed simultaneously on the displaying section 48 and on the display section 51. The display section 51 of the display panel 5 may be implemented with a 16 by 16 dots display by way of example. Controlled by the control section 55, the display section 51 displays thereon messages in alphanumeric and other characters, graphics and others.

Figures 4, 5:
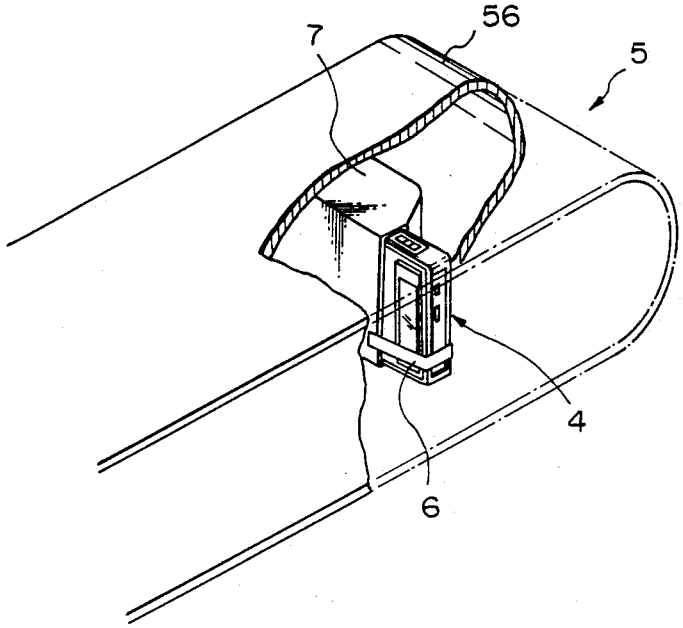
FIG. 4 is a view of a signal format applicable to the system of the present invention.
FIG. 5 is a perspective view of the paging receiver accommodated in the display panel.

Referring to FIG. 4, the message signal format is shown to consist of a BIT SYNC area, a FRAME SYNC area, an ADDRESS area, a COMMAND area, a DATA area, and an ERROR CORRECTION CODE area. The BIT SYNC area is representative of a signal for synchronizing a demodulator while the FRAME SYNC area is adapted to synchronize a frame and indicate that necessary data follows it. The ADDRESS area is representative of an address number assigned to an individual paging receiver and used to call a particular receiver. The COMMAND area is adapted to control a display mode and others; the display mode may be either a still display mode or a running display mode. The DATA area contains data to be displayed. As regards kanas (Japanese syllabary) and kanjis (Chinese characters), for example, character addresses as specified by JIS (Japanese Industrial Standards) C 6226 correspond to the DATA area. Further, the ERROR CORRECTION CODE area contains a self-correction code which may be the check bit of Bose Chaudkuri Hocquenghem (BCH) code.

Referring to FIG. 5, there is shown the receiver 4 which is mounted in a casing 56 of the display panel 5. As shown, the receiver 4 is fastened by a rubber strip 6 to a connector box 7 which is built in the casing 56. Installed in the connector box 7 is the input terminal 52 of the display panel 5 which is connected to the output terminal 41 of the receiver 4, as shown in FIG. 3.

In FIG. 3, it is to be noted that each of the connecting lines and terminals is representative of a plurality of connecting lines or terminals adapted for data, clock and others.

In summary, it will be seen that the present invention provides a radio message display system which achieves a message display function with a display panel in addition to a call message display function which is particular to a paging receiver. Such a capability is derived from a radio link which is established by a paging receiver and a paging transmitter between an encoder of a transmit side and a display panel of a receive side. In accordance with the present invention, therefore, the display panel can be installed and changed in layout with ease and, moreover, the contents to be displayed can be modified easily.

Various modifications will become possible for those skilled in the art after receiving the teachings of the present disclosure without departing from the scope thereof.

What is claimed is:

1. A radio message display system for displaying a message entered by transmitting the message over a radio link, comprising:

an input device for entering a message;

an encoder for coding an output of said input device;

a paging transmitter for modulating a carrier by an output of said encoder and transmitting said modulated carrier as a radio carrier;

a paging receiver having a receiving and demodulating section for receiving and demodulating the radio carrier to produce said message, a display section for displaying said message on said paging receiver, and an output terminal for outputting said message at the same time as said message is being received; and a display panel having an input terminal and a mounting section for mounting said paging receiver, said message being supplied from said output terminal to said input terminal when said paging receiver is mounted in said display panel, and a display for displaying said message from said input terminal.

2. The radio message display system of claim 1, wherein said display panel is T-shaped.

3. A message display system, comprising:

a radio pager and a display panel;

said radio pager including:

a display section;

first means for receiving a message transmitted over a radio carrier wave;

means for displaying the message on said display section;

output terminal means for issuing an output signal representative of said message; and means for supplying the message to said output terminal means at the same time as said message is being received;

said display panel including:

a display;

input terminal means for being connected to said output terminal means when said radio pager is mounted in said display panel;

means for mounting said radio pager;

means for receiving the message delivered to said input terminal means from said output terminal means; and means for displaying the message on the display.

4. The message display system of claim 3, wherein said display panel is T-shaped.

5. A method for displaying a radio transmitted message, comprising the steps of:

receiving a message transmitted over a radio link by means of a radio pager having a display section;

displaying the message on said display section;

mounting said radio pager in a display panel having a display;

applying the received message to said display panel at the same time as said message is being received; and displaying the message on said display.

6. A radio message receiver, comprising:

means for receiving a radio carrier carrying a message;

demodulating means for demodulating said message from said radio carrier;

a display section for displaying said message thereon;

control means coupled to said demodulating means for receiving said message and supplying said message to said display section for being displayed thereon; and auxiliary output means coupled to said control means for transmitting said message to an a auxiliary display device at the same time as said message is being received.

7. The radio message receiver of claim 6, further comprising a read only memory coupled to the control means for controlling same.

8. A combination of a large display panel and a radio pager, comprising:

said large display panel including:

a display panel housing;

a display control circuit;

a display mounted to the housing and coupled to said display control circuit for displaying thereon a message in characters large enough for simultaneous viewing by several persons from a greater than a predetermined distance;

mounting means for mounting in the housing a radio pager;

said radio pager including control means for receiving said message by detecting and demodulating a radio carrier carrying said message, a display section mounted on said radio pager, said control means being effective for displaying said message on said display section, output means in said radio pager for transmitting an electrical signal representative of said message to said display control circuit of said large display panel essentially at the same time as when said message is being received and is being transmitted to said display section;

said mounting means for said radio pager including means for connecting said output means of said radio pager to said large display panel for displaying thereon said message.

9. The combination of claim 9, wherein said large display panel comprises an input terminal for being mated to said output means of said radio pager when said radio pager is mounted in said large display panel.

10. The combination of claim 9, wherein said large display panel further comprises a character generator for receiving said electrical signal and for converting said electrical signal to electrical signals suitable for driving said display to cause said message to be displayed thereon.

11. The large display panel of claim 10, wherein said electrical signal is comprised of several signal fields.

12. The large display panel of claim 11, wherein said signal fields include a bit sync field, a frame sync field, an address field, a command field, data field, and an error-correcting code field.

* * * * *